US007586464B2

(12) United States Patent
Neto et al.

(10) Patent No.: US 7,586,464 B2
(45) **Date of Patent: *Sep. 8, 2009**

(54) BROADBAND LEAKY WAVE ANTENNA

(75) Inventors: Andrea Neto, Voorburg (NL); Giampiero Gerini, The Hague (NL); Simona Bruni, The Hague (NL); Marco Sabbadini, Leiden (NL)

(73) Assignee: Nederlandse Organisatie voor toegepast-natuurwetenschappelijk Onerzoek TNO, Delft (NL)

( * ) Notice: Subject to any disclaimer, the term of this patent is extended or adjusted under 35 U.S.C. 154(b) by 0 days.

This patent is subject to a terminal disclaimer.

(21) Appl. No.: 11/572,479

(22) PCT Filed: Jul. 15, 2005

(86) PCT No.: PCT/NL2005/000513

§ 371 (c)(1),
(2), (4) Date: Apr. 30, 2008

(87) PCT Pub. No.: WO2006/009432

PCT Pub. Date: Jan. 26, 2006

(65) Prior Publication Data

US 2008/0198081 A1 Aug. 21, 2008

(51) Int. Cl.
*H01Q 15/08* (2006.01)
*H01Q 13/10* (2006.01)
*H01Q 13/00* (2006.01)

(52) U.S. Cl. ..... 343/911 R; 343/771; 343/785

(58) Field of Classification Search ..... 343/767, 343/771, 846, 911 R, 909, 785
See application file for complete search history.

(56) References Cited

U.S. PATENT DOCUMENTS

| | | | | |
|---|---|---|---|---|
| 6,445,354 | B1 * | 9/2002 | Kunysz | 343/770 |
| 6,597,323 | B2 * | 7/2003 | Teshirogi et al. | 343/786 |
| 6,995,724 | B2 * | 2/2006 | Teshirogi et al. | 343/771 |
| 7,209,088 | B2 * | 4/2007 | Maruyama et al. | 343/772 |
| 2008/0266197 | A1 * | 10/2008 | Neto et al. | 343/785 |

FOREIGN PATENT DOCUMENTS

EP 1 006 611 A2 6/2000

OTHER PUBLICATIONS

Neto, et al., "Green's function for an infinite slot printed between two homogeneous dielectrics. I. Magnetic currents," IEEE Transactions on Antennas and Propagation, IEEE, USA, vol. 51, No. 7, Jul. 2003, pp. 1572-1581.
International Search Report for PCT/NL2005/000513 dated Sep. 30, 2005.

* cited by examiner

*Primary Examiner*—Shih-Chao Chen
(74) *Attorney, Agent, or Firm*—Leydig, Voit & Mayer Ltd.

(57) ABSTRACT

An antenna comprises a conically shaped body of dielectric material. Cross-sections of the body have truncated elliptical shape, wherein each shape is truncated substantially through a first focus of the elliptical shape along a truncation line that extends substantially perpendicularly to a main axis of the elliptical shape. The second focus of the elliptical shape lies within the body. An elongated wave carrying structure such as a slot in a conductive ground plane extends substantially along a focal line through the first focus of the elliptical shapes in successive cross-sections. This structure supports transmission and/or reception over a wide range of frequencies. In an embodiment a multi-frequency feed structure is integrated in the ground plane of the antenna.

14 Claims, 2 Drawing Sheets

BROADBAND LEAKY WAVE ANTENNA

FIELD OF THE INVENTION

The invention relates to a broadband leaky wave antenna.

BACKGROUND

In the IEEE Transactions on Antennas and Propagation Vol. 51 No. 7 Jul. 2003 pages 1572-1581 an article has been published titled "Green's function for an Infinite Slot Printed Between Two Homogeneous Dielectrics, Part I: Magnetic Currents", by Andrea Neto and Stefano Maci. A second part of this article has been published in the IEEE Transactions on Antennas and Propagation Vol. 52 No. 3 Mar. 2004, on pages 666-676. The first article mentions the possibility of building a sub-millimeter wave receiver that is integrated with a dielectric lens and that contains a slot printed on an infinite slab.

The articles describe the properties of electromagnetic waves that travel along a structure with a conductive ground plane that contains a narrow elongated non-conductive slot, when two dielectric media with different dielectric constants $\epsilon_1$ $\epsilon_2$ are present on opposite sides of the ground plane. It is shown that in this configuration a wave travels along the length of the slot, and that part of the wave energy is radiated under a predetermined angle relative to the ground plane.

The articles refer to the possibility of using this phenomenon to realize a leaky wave antenna, but give no details about the structure of such an antenna. In a leaky wave transmission antenna an electromagnetic wave travels along a wave guiding structure so that at successive points along the structure each time a fraction of the wave energy is radiated to the far field. As a result the wave energy gradually decreases along the structure. The travelling wave defines predetermined phase relationships between the radiation from different points along the structure and thereby a direction (if any) in which the radiation from the points leads to coherently radiation, so that the structure acts as an antenna. Usually, leaky wave antennas have a limited bandwidth, which is defined by the characteristic dimensions of the wave guiding structure.

SUMMARY OF THE INVENTION

Among others, it is an object of the invention to provide for a broadband antenna.

Among others, it is another object of the invention to provide for a feed structure for a broadband antenna.

Among others, it is a further object of the invention to provide for a multiple frequency feed structure for a broadband antenna.

The antenna according to the invention is set forth in claim 1. According to the invention an antenna with an at least partly conically shaped dielectric body is provided. The conical shape is such that the body has a series of cross-sections shaped like a truncated ellipses. Of the two foci of each ellipse a first one lies on a truncation line along which the truncated ellipse ends. An elongated wave carrying structure, such as a linear non-conductive slot in a conductive ground plane or a conductive track, extends along a focal line through the first foci of the truncated elliptical cross-sections. The second focus lies within the body. The truncation line extends perpendicularly to an axis of the ellipse through the foci. If a conductive ground plane is used, the ground plane adjoins the surface formed by the truncation lines of successive cross-sections.

It has been found that the dielectric body with elliptical cross-sections has the effect that the properties of wave propagation along the elongated wave carrying structure closely resemble the theoretical properties that would apply if a dielectric body that occupy an infinite half-space were used. That is, the speed of propagation hardly depends on wavelength as long as the wavelength is considerably larger than the width of the wave carrying structure. This results in coherent leaky wave radiation in a direction at an angle with respect to the focal line, the angle being substantially wavelength independent, so that broadband antenna behaviour is realized. Preferably the elongated wave carrying structure has a linear straight-line shape, but non-linear shapes, combined with corresponding size variations and offsets of the elliptical cross-sections may be used as an alternative to realize special antenna patterns.

Preferably the main axis of each of the elliptical shapes (the axis through the two foci) coincides with the direction of coherent propagation of the leaky wave. In this way the best approximation of the effect of an infinite dielectric half space is obtained.

Preferably the size of the cross-sections tapers along the cone so that a virtual line, which runs through the points on the perimeters of the elliptical shapes that are furthest from the first focus, is perpendicular to the direction of coherent propagation of the leaky wave. In this way optimal coupling of leaky wave radiation from the dielectric body to the exterior is realized.

Preferably the ellipticity of the elliptical shape is substantially equal to a square root of a relative dielectric constant of the dielectric material. This ellipticity applies to cross-sections in virtual plane that are oriented so that the truncation line is perpendicular to the focal line. This further optimizes the broadband behaviour.

In an embodiment a feed structure is provided integrated on a surface of the body defined by the truncation lines of the elliptical shapes of the cross-sections. This makes it possible to realize a cost-effective efficient feed. As used herein the term "feed" applies to transmission as well as reception with the antenna, that is, both to transfer of field energy to and from the wave carrying structure.

In a further embodiment the feed structure that comprises a coplanar wave guide with a pair of parallel non conductive feed slots in the ground plane with a tongue of conductive material in between. The coplanar wave-guide extends transverse to and across the antenna slot in the ground plane, and is terminated so that a short-circuit impedance arises in a coplanar waveguide at a position where the coplanar waveguide crosses the antenna slot. In this way optimal coupling is realized between the feed structure and the antenna slot. Preferably a part of the antenna slot extends beyond the point where the coplanar waveguide crosses the antenna slot. This part of the antenna slot extends so far that at an operation frequency waves excited in said part are reflected in phase back to the point where the coplanar waveguide crosses the antenna slot.

In another embodiment a plurality of coplanar wave guides are used as feed structures for different frequencies, arranged so that fields of each frequency are presented with open-circuit impedance at the crossing points of all but one of the coplanar wave guides. In this way optimal isolation between the feed structures is realized.

Similar feed structures can be realized when a conductive track is used as wave carrying line.

The antenna may be used in combination with transmission and/or reception apparatus that is arranged successively and/or simultaneously to supply and/or receive the signals with mutually different frequencies that are far apart in frequency, for example at least a factor of two apart or even more. Efficient antenna behaviour (i.e. with well defined main lobes) for all these frequencies is realized with a single cone shaped antenna structure. Even transmitter and/or receptor equipment that handles signals with frequencies that are further apart may be used with effective antenna behaviour for all these frequencies.

BRIEF DESCRIPTION OF THE DRAWINGS

These and other objects and advantageous aspects of the invention will be described by non-limitative examples using the following figures.

DETAILED DESCRIPTION OF THE DRAWINGS

Figure 1:
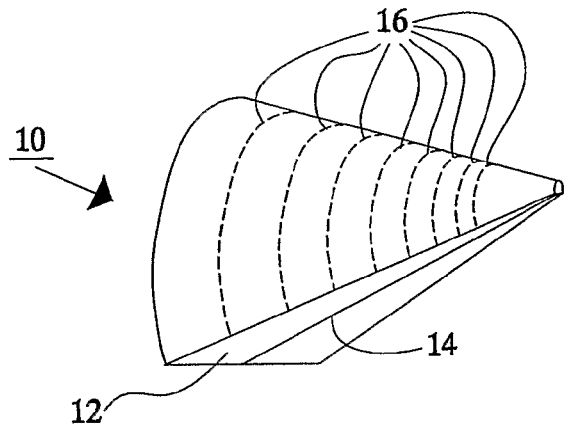
FIG. 1 shows an antenna structure.

FIG. 1 shows an antenna structure. The antenna structure comprises a dielectric body 10, which is shown schematically by a number of cross-sections 16. A conductive ground plane 12 is attached underneath the dielectric body. A narrow non-conductive antenna slot 14 runs along the length of the antenna structure in ground plane 12. Dielectric body 10 is of conical shape, with cross-sections 16 that have the shape of truncated ellipses. The truncations rest on ground plane 12.

Figure 2:
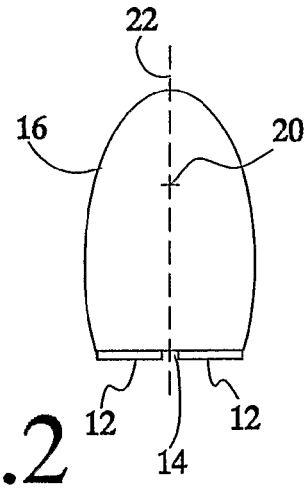
FIG. 2 shows a cross-section of an antenna structure.

FIG. 2 illustrates one cross-section 16 of the dielectric body, showing its truncated elliptical shape, a cross-section of ground plane 12 (with exaggerated thickness) and a cross-section of antenna slot 14 (with exaggerated width). A virtual line 22 shows the main axis of the ellipse (the axis through its focal points; as is well known the two focal points of the ellipse are defined by the fact that the sum of the distances from any point on the perimeter of the ellipse to both focal points is independent of the point on the perimeter). Antenna slot 14 runs substantially through a first one of the foci (focal points) of the ellipse and extends, transverse to the plane of the drawing through foci of the elliptical shapes of other cross-section. The second focus (focal point) 20 of the ellipse lies within dielectric body. The ellipse is truncated along a line that runs perpendicular to the main axis of the ellipse and substantially through the first focus of the ellipse. Ground plane 12 extends transverse to the elliptical cross-sections 16.

Figure 3:
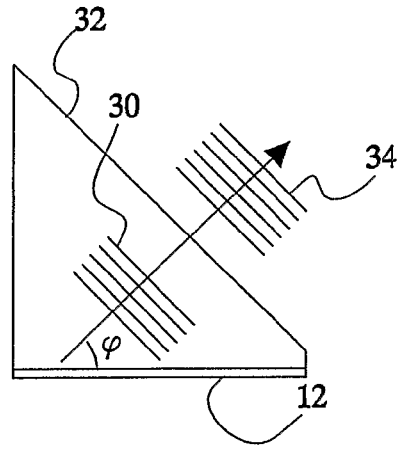
FIG. 3 shows another cross section of an antenna structure.

FIG. 3 shows another cross-section of the dielectric body, in this case through a plane that runs through the main axes 22 of successive cross-sections and parallel to antenna slot 14 (not shown). Dielectric body may be made for example of TMM03 material, on sale in the form of slabs from Rogers. This material has a relative dielectric constant of 3.27. Of course other materials may be used, for example with a relative dielectric constant between 1.5 and 4. In the case that slab shaped material is used, the slabs may be stacked and shaped to realize the electric body. The lowest slab may be provided with an attached copper ground plane with a thickness of approximately 0.1 millimeter in which antenna slot 14 may be milled, with a width of say 0.2 millimeter. However, it should be realized that these dimensions and this way of manufacturing are merely given by way of example. The width should preferably be less than a quarter of the wavelength in the dielectric material. The width of 0.2 millimeter may be used for frequencies in the range of 10-30 Gigahertz. Higher frequencies, even in the Terahertz range are possible, but in that case a narrower slot should be used. Other dimensions and manufacturing techniques may be used.

Operation of the antenna is based on the fact that the propagation speed of waves along a slot 14 in a conductive ground plane 12 is substantially independent of the wavelength of the wave, if ground plane 12 is bounded by two infinite half-spaces of mutually different dielectric constant, provided that the slot width is substantially smaller than the wavelength (smaller than a quarter of the wavelength). This means that such a slot will act as a leaky wave antenna, which radiates into one of the half-spaces in a direction that is independent of the wavelength of the radiation.

In practice infinite half spaces of dielectric material are of course impossible. This means that finite bodies of material must be used, but normally the finite size of the body affects the speed of propagation of the waves along antenna slot 14 in a wavelength dependent way. This wavelength dependence limits the antenna bandwidth, and makes the direction of radiation wavelength dependent.

In the present antenna, the wavelength dependence is minimized by the use of a dielectric body 10 with truncated elliptical cross-sections with one focus at the position of the antenna slot 14. Preferably, cross-sections through plane parallel to the direction of propagation of the leaky wave through the dielectric have this shape and have their first focus at the antenna slot 14. As will be appreciated this direction depends on the speed of wave propagation along antenna slot 14, which in turn depends on the dielectric constants of the dielectric material of body 10 and the surrounding space. The required direction can be determined theoretically, by means of simulation or by means of analytical solutions, or experimentally, by observing the direction of propagation in the dielectric body.

The half-space below ground plane 12 is formed by air (or a vacuum, or by some other gas or fluid). The upper half-space is approximated by the dielectric body 10. Because of the elliptical cross-sections radiation from the antenna slot 14 can only react back on the antenna slot 14 after two reflections on the perimeter of the dielectric body 10. This minimizes the effect of the finite size of dielectric body 10, with the result that the wavelength independent propagation speed for an infinite half space is closely approximated. Preferably, the elliptical cross-sections are shaped so that their eccentricity substantially equals the square root of the relative dielectric constant of the dielectric body 10 with respect to that of the surrounding space.

The result is that radiation leaks from antenna slot 14, giving rise to wavefronts 30 at an angle $\phi$ to ground plane 12, the angle $\phi$ being determined by the speed of propagation along antenna slot 14, which is a function of the dielectric constant of the dielectric body but is substantially independent of the wavelength. In the case of the example where the dielectric constant is 3.27 the angle $\phi$ equals approximately forty degrees.

In the embodiment of the figures the size of the elliptical cross-sections tapers towards the end of the antenna structure so that, at least on the main axes 22 of the ellipses, the wave-fronts 30 of equal phase run parallel to the top line surface 32 at the top of the ellipse (where the main axes 22 cross the surface of the ellipse) toward which the wave-fronts 30 travel. As a result, the wave has normal incidence on top line surface 32 and proceeds with wave-fronts 34 in the same direction after leaving the dielectric body. This arrangement with a tapering so that top line surface 32 is substantially perpendicular to the direction of propagation of the radiated wave is preferred to minimize reflections. However, without deviating from the invention top line surface 32 may be at an angle with respect to the wave-fronts 30, as long as the angle is kept so small that no total reflection occurs this merely results in breaking of the direction of radiation When the radiation leaves dielectric body 10, with some increased loss due to reflections.

As shown, ground plane 12 extends substantially over the full width of the truncations, but no further. This is convenient for mechanical purposes, but not essential for radiative purposes: without deviating from the invention the ground plane may extend beyond the elliptical cross-sections or cover only part of the truncation. Preferably the width of the ground plane 12 away from the slot is so selected large that it contains the area wherein the majority of the electric current flows according to the theoretical solution in the case of an infinite ground plane, for example so that the ground plane 12 extends over at least one wavelength on either side of the slot 14 and preferably over at least three to four wavelengths.

A conductive track may be used instead of non-conductive antenna slot 14 that is shown in the figures, when the conductive ground plane 12 is omitted or replaced by a non-conductive ground plane. Like the antenna slot 14, such a conductive track that extends through one of the foci of successive cross-sections gives rise to substantially wavelength independent propagation speed and leaky wave radiation that provides an antenna effect.

Typically a single non-conductive slot or conductive track extends through the focal line. In the case of the slot this leads to a propagating field structure with electric field lines from one half of the ground plane to the other and magnetic field lines through the slot, transverse to the ground plane. Preferably no additional slot is provided in parallel with the slot. However, a similar propagating field may be realized with one or more additional slots in parallel to the slot, provided that these slots are excited in phase with the excitation of the slot, or at least not excited completely in phase opposition to the excitation of the slot. Out of phase (but not opposite phase) excitation of different slots may be used to redirect the antenna beam.

Similar considerations hold for the conductive track, except that the role of magnetic and electric fields is interchanged. Preferably a single conductive track is used, but more than one track may be used, provided that the tracks are preferably not excited in mutual phase opposition.

Although the invention is illustrated for the case of transmission of radiation, it will be realized that, owing to the principle of reciprocity, the antenna also operates to receive radiation from the direction in which it can be made to radiate, i.e. from a substantially wavelength independent direction.

Figure 4:
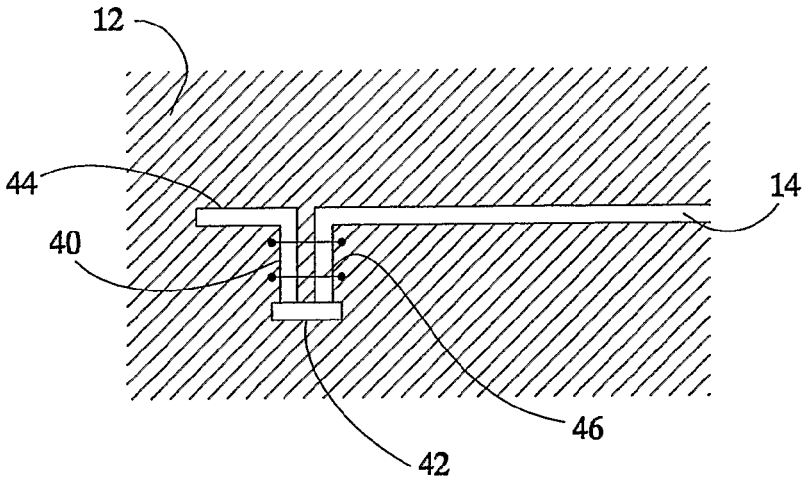
FIG. 4 shows a feed structure.

FIG. 4 shows an example of a feed structure of the antenna. Preferably the feed structure is integrated in ground plane 12. The feed structure of FIG. 4 is one embodiment; comprising two mutually parallel feed slots 40 on either side of a tongue of conductive material transverse to antenna slot 14. Feed slots 40 form a coplanar wave guide that ends in a short-circuit at antenna slot 14.

The feed structure makes use of magnetic field excitation, which excites a wave in antenna slot 14 by means of a magnetic field in the slot with field lines substantially perpendicular to ground plane 12. Such a magnetic field can be induced with a conductor that crosses the antenna slot, such as the tongue between feed slots 40.

Because the coplanar wave guide ends in a short-circuit at antenna slot 14, a current maximum is created (and therefore a magnetic field maximum) at the position of antenna slot 14. Thus maximum excitation of waves in antenna slot 14 is realized. Antenna slot 14 extends over the length of the antenna in one direction and for a finite length 44 beyond the point where feed slots 40 end in antenna slot 14 in the other direction. The finite length 44 preferably corresponds to a quarter wavelength of the waves (optionally plus an integer number of half wavelengths), so that waves that are reflected at the end of finite length are in phase with the directly excited wave. At the end of feed slots 40 opposite to antenna slot 14 a feed connection 42 to a transmitter or receiver circuit (not shown) is provided. Feed connection 42 is arranged to apply a symmetric field from a central portion of ground plane 12 between feed slots to the parts of the ground plane on either side of feed slots 40. Optionally, conductive bridges 46 couple the parts of the ground plane on either side of feed slots 40 to suppress anti-symmetric modes.

It should be noted that the length of the various slots of the feed structure limit the bandwidth of the antenna. Typically a useful frequency bandwidth of 50% of the central frequency can be reached.

It will be realized that feed slots 40 may extend through antenna slot 14 instead of terminating at antenna slot 14. In this case the feed slots 40 may extend for an integer number of half wavelengths, the tongue being connected to the ground plane at the end, so that a short-circuit impedance is realized in the coplanar waveguide at the position where it crosses antenna slot 14. Alternatively, the tongue may end in an open-circuit, in which case the feed slots 40 preferably extend for a quarter wavelengths (plus any number of integer wavelengths) to realize a short-circuit impedance in the coplanar waveguide at the position where it crosses antenna slot 14. Due to impedance effects of the way the tongue is terminated a slight deviation from these lengths may be required to create a short-circuit impedance at the position where it crosses antenna slot 14.

Figure 5:
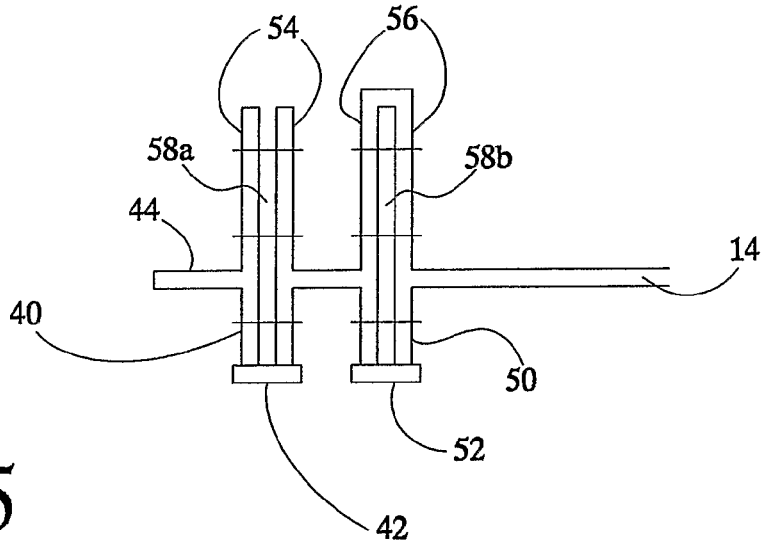
FIG. 5 shows a further feed structure.

FIG. 5 shows another example of a feed structure in the ground plane. For the sake of clarity the ground plane is not explicitly indicated: only the boundaries of slots in the ground plane are indicated. In this example two pairs of feed slots 40, 50 are provided, for applying fields of different frequencies at respective feed connections 42, 52. Isolating structures 54, 56 are provided, both realized as pairs of slots in the ground plane transverse to antenna slot 14, with a tongue 58*a,b* of conductive material in between the slots 54, 56. The feed slots 40, 50 extend into isolating structures 54, 56, so that the tongues 58*a,b* of the ground plane between the feed slots 40, 42 extends between the slots of the isolating structures 54, 46, crossing antenna slot 14. Although only two feed structures are shown, it should be understood that a greater number of similar structures could be provided.

Isolating structures 54, 56 serve to suppress cross-coupling between the feed connections 42, 52. In operation fields of respective, mutually different frequencies are applied to the feed connections 42, 52. Cross-coupling is realized by minimizing the magnetic field coupling at the point where a particular feed structure crosses antenna slot 14 for all applied frequencies but the frequency of the field that is applied by the feed connection 42, 52 of the particular feed structure (in the example of the figure the magnetic field couplings at the respective crossings each needs to be minimized only for one respective frequency). The magnetic field coupling is realized by providing an open-circuit impedance at the point where a feed connection 42, 52 supplies the field to antenna slot 14 for the non-coupling frequency (or frequencies).

In the example, one frequency is twice the other frequency. The slots of the isolating structure 54 that face the highest frequency feed connection 42 end in a short-circuit and have a length of half a wavelength for that frequency, and consequently, a quarter of a wavelength for the lower frequency of the other feed connection 52. This results in a short-circuit impedance at the position antenna slot for the high frequency and an open-circuit impedance at that position for the low frequency. As a result there is maximum coupling between the feed structure and antenna slot 14 for the highest frequency and minimum coupling for the lowest frequency.

The slots of the isolating structure 54 that face the lowest frequency feed connection 52 end in an open-circuit and also have a length of half a wavelength for the highest frequency, and consequently, a quarter of a wavelength for the lower frequency. This results in a short-circuit impedance at the position antenna slot for the low frequency and an open-circuit impedance at that position for the high frequency. As a result there is maximum coupling between the feed structure and antenna slot 14 for the lowest frequency and minimum coupling for the highest frequency.

Due to impedance effects of the way the tongues are terminated slight deviations from these lengths may be required to create short-circuit and open-circuit impedance at the position where it crosses antenna slot 14.

Preferably, the length of the slot between the feed structures and the finite length 44 are a quarter wavelength of the lower frequency. Thus, waves that are reflected back into antenna slot 14 from the end of finite length 44 are in phase with directly excited waves for both frequencies.

Figure 6:
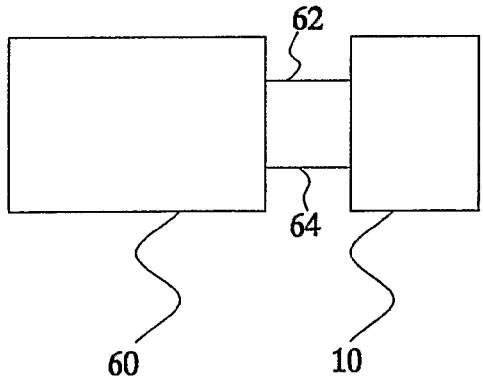
FIG. 6 shows a transmission and/or reception system.

FIG. 6 shows a transmission and/or reception system comprising a transmitter and/or receiver 60 with two connections 62, 64 connected to antenna structure. The system supplies and/or receives fields at two different frequencies to and/or from antenna structure. In an example transmitter and/or receiver 60 is arranged to transmit and/or receive signals of which the frequencies are a factor two apart. Transmitter and/or receiver 60 may comprise separate apparatuses for these two frequencies, but a combined apparatus may be used alternatively.

It should be appreciated that the actual antenna structure with antenna slot 14 is suitable for an extremely broad band of frequencies. The frequencies of the example, which are a factor two apart easily fit into this broadband. In the example only the feed structure limits the bandwidth. In practice a dual band antenna is realized which can be operated in two bands of about 30% bandwidth (width divided by central frequency).

Although the feed structure has been described for the example of excitation with two frequencies, of which one is twice the other, it should be appreciated that different feed structures are possible for different combinations of frequencies, or for a greater number of frequencies. In this case more complicated isolating structures may be required to provide substantially open-circuit impedances for "other" frequencies at the points where fields are fed to antenna slot 14. Also for example antenna slot 14 may be split into branching slots in the feed structure to accommodate several frequencies.

As another example measures to suppress cross-coupling may be taken in the transmission and/or receiver apparatus 60 that is connected to the feed connections. Furthermore, it should be understood that, instead of integrated coplanar waveguides, other types of feed structures could be used, such as external waveguides that interface with antenna slot 14.

When a conductor track is used instead of antenna slot 14, feed structures may be used that are the dual of the feed structure for antenna slot, i.e. wherein conductive parts are replaced by non-conductive parts and vice versa. In this case, instead of the coplanar wave guides bifilar feed structures are used, composed of a pair of adjacent conductors.

By now it will be appreciated that an extremely broadband antenna structure is realized by means of an antenna structure with a dielectric body of truncated elliptical cross-section, with a ground plane with a slot that extends through the foci of the elliptical cross-sections or a conductor that extends through the foci. Transmitter and/or receiver equipment 60 may be attached to the antenna structure to supply and/or receive fields of widely different frequency simultaneously and/or successively to the antenna structure for effective transmission and/or reception. Various feed structures may be used to excite or receive waves from the antenna slot. In an embodiment the feed structures may be integrated in the ground plane. Typically, the feed structures are selected dependent on the frequency or frequencies at which the transmitter and/or receiver equipment 60 uses the antenna structures. Although specific feed structures have been shown, it should be appreciated that other feed structures are possible, such as a waveguide that debouches at some position in the slot, or along a range or series of positions. If the antenna is used at widely different frequencies respective feed structures for such different frequencies may be used. Especially when these frequencies are far apart (e.g. a factor of ten) it is not very difficult to ensure that different feed structures for the respective frequencies do not interfere with each other.

Although a preferred antenna structure has been shown which is conical along its entire length with a straight line through the focal points, it should be appreciated that without deviating from the invention only part of the antenna may be conically shaped and that the line through the focal points may be curved. In the former case the conically shaped part provides for a directional behaviour of the antenna beam. A curved line (and therefore a curved slot or conductor track) results in locally varying directions of propagation of the leaky wave. By varying the size of the ellipses in a corresponding way it can be ensured that leaky waves from different parts of the focal line through the focal points interfere coherently after leaving dielectric body. Also multiple antenna lobes may be realized for example by using slots containing different parts at an angle with respect to one another and/or truncated elliptical cross-sections that taper in different ways at different points along the conical body.

The invention claimed is:

1. An antenna, comprising an at least partly conically shaped body of dielectric material, having a series of cross-sections of truncated elliptical shape, wherein each cross-section of truncated elliptical shape is truncated substantially through a first focus elliptical shape along a truncation line that extends substantially perpendicularly to a main axis of the elliptical shape, a second focus of the elliptical shape lying within the body; and an elongated wave carrying structure extending substantially along a focal line through the first focus of the elliptical shape in successive cross-sections of the series of cross-sections of truncated elliptical shape.

2. An antenna according to claim 1, wherein the main axes of respective ones of the elliptical shapes substantially coincide with a direction, of coherent propagation of a leaky wave from the elongated wave carrying structure into the dielectric material.

3. An antenna according to claim 1, wherein a size of individual ones of the series of cross-sections tapers so that a virtual top line formed by the series of cross-sections is perpendicular to a direction of coherent propagation of a leaky wave from the elongated wave carrying structure into the dielectric material, the virtual top line running through where a perimeter of body crosses the main axes of the elliptical shapes of the series of cross-sections.

4. An antenna according to claim 2, wherein the series of cross-sections are oriented so that, for each of the cross-sections, the truncation line is perpendicular to the focal line and an eccentricity of the elliptical shape is substantially equal to a square root of a relative dielectric constant of the dielectric material relative to a dielectric constant of a surrounding space around the body.

5. An antenna according to claim 1, further comprising a feed structure integrated on a surface of the body, which surface is defined by the truncation lines of the series of cross-sections of truncated elliptical shape.

6. An antenna according to claim 1, further comprising a conductive ground plane located adjoining a surface of the body that is defined by the truncation lines of the series of cross-sections of truncated elliptical shape, and a non-conductive antenna slot in the ground plane extends along the focal line to form the wave carrying structure.

7. An antenna according to claim 6, comprising a first feed structure that comprises a pair of parallel nonconductive feed slots extending in the ground plane transverse to the antenna slot with a tongue of conductive material in between the feed slots, the tongue extending across the antenna slot, the tongue being terminated so that a short-circuit impedance arises in a first coplanar waveguide formed by the feed slots and the tongue at a position, where the coplanar waveguide crosses the antenna slot.

8. An antenna according to claim 7, wherein a part of the antenna slot extends beyond the point where the first coplanar waveguide crosses the antenna slot, said part extending by a length so that waves that are excited in operation in said part are reflected in phase back to said point.

9. An antenna according to claim 7, comprising a second coplanar waveguide extending in the ground plane transverse to the antenna slot, the second coplanar waveguide extending on a first and second side of the antenna slot, the second coplanar waveguide terminating after extending a length on the first side so that an open-circuit impedance is formed for waves from the first feed structure at a further point where the second coplanar wave guide crosses the antenna slot.

10. An antenna according to claim 1, further comprising a elongated conductive track extending along the focal line, adjoining a surface of the body defined by the truncation lines of the elliptical shapes of the cross-sections.

11. An antenna according to claim 10, further comprising a first feed structure that comprises a pair of parallel conductive feed lines extending on the surface formed by the truncation lines transverse to the conductor track and electrically attached to the conductor track so that a short-circuit impedance arises in a first bifilar waveguide formed by the feed lines at a position, where the first bifilar waveguide attaches to the antenna slot.

12. An antenna according to claim 11, wherein a part of the conductor track extends beyond a point where the first bifilar waveguide attaches to the conductive track by a length so that waves excited in said part are reflected in phase back to said point.

13. An antenna according to claim 11, further comprising a second bifilar waveguide extending in on the surface formed by the truncation lines transverse to the conductive track, the second bifilar waveguide extending on a first and second side of the conductive track, the second bifilar waveguide terminating after extending a length on the first side so that an open-circuit impedance is formed for waves from the first feed structure at a further point where the second bifilar wave guide attaches to the conductive track.

14. A transmission and/or reception apparatus, comprising:

an antenna comprising:

an at least partly conically shaped body of dielectric material, having a series of cross-sections of truncated elliptical shape, wherein each cross-section of truncated elliptical shape is truncated substantially through a first focus of an elliptical shape along a truncation line that extends substantially perpendicularly to a main axis of the elliptical shape, a second focus of the elliptical shape lying within the body; and an elongated wave carrying structure extending substantially along a focal line through the first focus of the elliptical shape in successive cross-sections of the series of cross-sections of truncated elliptical shape; and a signal processing apparatus that is operative to receive signals received by the antenna and/or supply signals for transmission by the antenna, the apparatus being arranged successively and/or simultaneously to supply and/or receive the signals with mutually different frequencies that are at least a factor of two apart.

* * * * *

UNITED STATES PATENT AND TRADEMARK OFFICE

CERTIFICATE OF CORRECTION

PATENT NO. : 7,586,464 B2
APPLICATION NO. : 11/572479
DATED : September 8, 2009
INVENTOR(S) : Andrea Neto et al.

It is certified that error appears in the above-identified patent and that said Letters Patent is hereby corrected as shown below:

On the title page, add foreign application priority data as follows:

item [30] Foreign Application Priority data
Jul. 23, 2004 [EP] ..... 04077132

Signed and Sealed this

Twentieth Day of October, 2009

David J. Kappos

David J. Kappos
*Director of the United States Patent and Trademark Office*